United States Patent [19]

Abels

[11] 4,026,432

[45] May 31, 1977

[54] LIFT-VEHICLE ASSEMBLY

[75] Inventor: Theodor Abels, Aschaffenburg-Nilkheim, Germany

[73] Assignee: Linde Aktiengesellschaft, Wiesbaden, Germany

[22] Filed: Apr. 4, 1975

[21] Appl. No.: 565,111

Related U.S. Application Data

[62] Division of Ser. No. 375,008, June 29, 1973, Pat. No. 3,930,563.

[30] Foreign Application Priority Data

July 6, 1972 Germany ..... 2233281

[52] U.S. Cl. ..... 214/672; 187/9 E; 187/95

[51] Int. Cl.[2] ..... B66F 9/08

[58] Field of Search ..... 187/9 E, 17, 24, 25, 187/95; 52/115, 118; 214/660, 670–674; 254/89 H, 93 R

[56] References Cited

UNITED STATES PATENTS

| | | | |
|---|---|---|---|
| 2,456,320 | 12/1948 | Repke | 214/674 |
| 2,915,144 | 12/1959 | Olson | 187/9 E |
| 2,915,210 | 12/1959 | Ehmann | 187/9 E X |
| 3,072,219 | 1/1963 | Olson | 187/9 E |
| 3,344,890 | 10/1967 | Loef | 187/9 E |
| 3,777,853 | 12/1973 | Miller | 187/9 R |

*Primary Examiner*—Evon C. Blunk
*Assistant Examiner*—James L. Rowland
*Attorney, Agent, or Firm*—Karl F. Ross; Herbert Dubno

[57] ABSTRACT

A lift assembly for an industrial vehicle, e.g. a fork-lift truck, comprises a pair of transversely spaced uprights mounted upon a common tiltable frame formed with cylinders for plunger-type pistons carried by the vertically displaceable members of the lift device. A lift carriage with a fork is shiftable upon these members and is engaged by the end of a chain passing over a pulley or sprocket wheel carried by the vertically shiftable members for relative displacement of the carriage and the latter members.

12 Claims, 16 Drawing Figures

FIG. 10
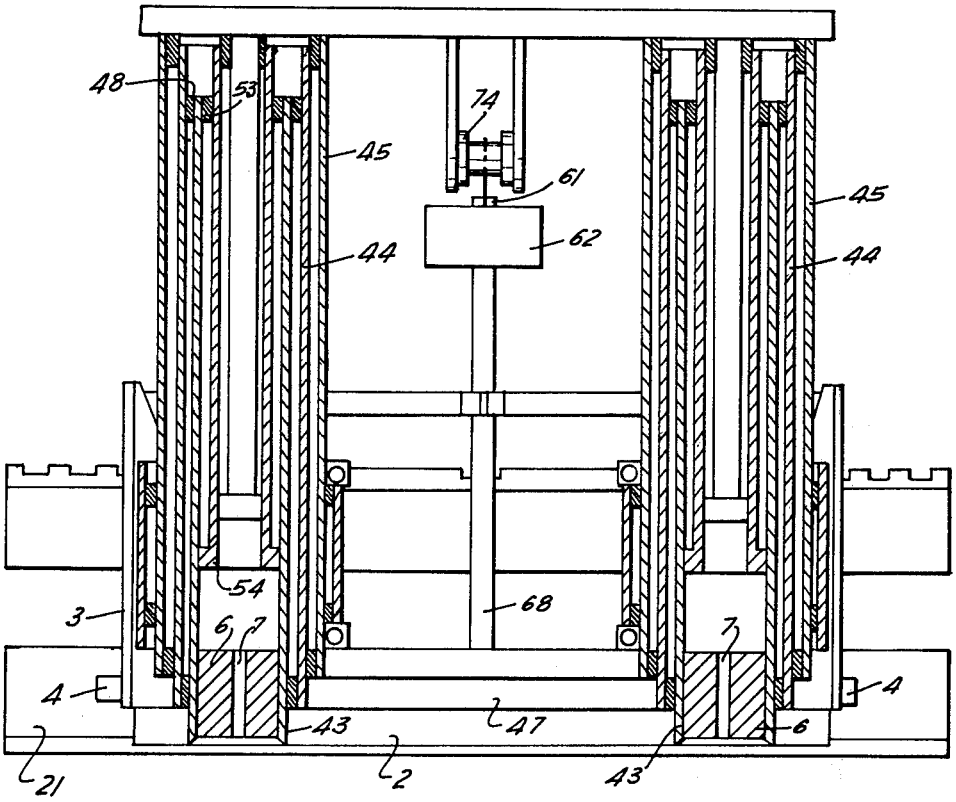
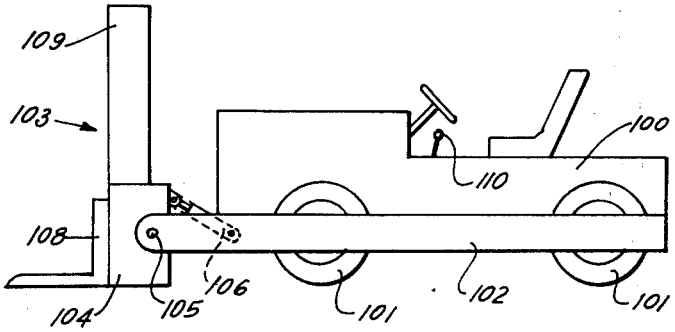
FIG. 16

LIFT-VEHICLE ASSEMBLY

CROSS REFERENCE TO RELATED APPLICATION

This application is a division of Ser. No. 375,008 filed June 29, 1973, now Pat No. 3,930,563 and entitled LIFT VEHICLE.

FIELD OF THE INVENTION

The present invention relates to a lift assembly for an industrial vehicle and, more particularly, to the lifting device of a fork-lift truck or the like.

BACKGROUND OF THE INVENTION

Fork-lift vehicles and like industrial trucks are commonly provided with an upright structure or mast, tower or pylon carried by the front of the vehicle and, in turn, provided with a lifting fork designed to engage beneath the supporting surface of a pallet to enable lifting of a load carried thereby. Various systems have been provided for elevating the fork and these include rack-and-pinion, hydraulic, nut-and-spindle and similar arrangements.

However, difficulties have been encountered with conventional lifting devices because they must satisfy a number of prerequisites. For example, the lifting device must not obscure the field of view of the vehicle operator and, on the other hand, must be sufficiently stable as to withstand the load forces and vibration disturbances which arise as the vehicle carries a load from one location to another. Furthermore, considerable structural strength is a prerequisite since the center of gravity of the load is frequently located ahead of the center of gravity of the lifting rack so that considerable bending stress in applied, at least when large loads are carried.

Various solutions to the problem have been proposed and some of the state of the art in this regard is imperative.

There are, for example, lifting racks for fork-lift and like industrial vehicles which comprise a pair of profiled uprights, i.e. uprights of U-cross-section, T-section and double T-section or more complicated profiles. Such profiles have been thought to be necessary to resist the considerable bending stresses which must be absorbed by the rack.

A carriage is vertically shiftable on these uprights and may cooperate with vertically displaceable beams of similar or more complicated profile which slidably interfit with the stationary profiles. While these racks do not materially limit the field of view of the operator and thus are advantageous in this regard, they are expensive and complicated to manufacture, are heavy and thus require increased structure in the vehicle upon which the rack is mounted and, when increased in size to withstand particularly massive loads, must be made so wide as to interfere with the operator's view of the work area ahead of the vehicle.

With such racks, moreover, vibration and relative lateral movement of the interfitting parts is observed during motion of the vehicle and, indeed, the vehicle has relatively poor lateral stability. The vibration, chattering and like deficiencies arise in part because the bending movement in the plane of the uprights may not be sufficiently resisted by the profile members.

Moreover, when a loaded vehicle negotiates a turn or curve, momentum or inertia of the load applies lateral stresses to the structure which results in an impact of the movable parts of the frame upon the stationary parts thereof since the latter invariably cooperate with considerable play therebetween.

The difficulty encountered with such arrangements in one of continuing compromises since the width of the uprights should be minimal to provide the fullest possible field of view for the operator, but a reduced width also involves reduced lateral stiffness and resistance to bending with increased instability in the overall structure.

The problem is multiplied by the fact that the system must be designed to carry heavy loads with centers of gravity offset from the plane of the uprights at distances well above the top of the stationary portion of the rack and even during motion of the vehicle. Hence, any elasticity in the coupling between the interfitting vertical members or uprights or within these members or uprights or within these members themselves can only lead to bending-type oscillations when the stability of the uprights, whether movable or stationary, is reduced to afford greater visibility.

There is also known a lift mechanism for a fork-lift truck or the like which comprises a single central mast having two telescopically interfitting parts, the mechanism being of the type known as a MONO-MAST in which the lifting system is simplified although stability is reduced and a serious impediment to proper viewing of the working zone is imposed by the central arrangement of the mast.

A single mast arrangement, moreover, is sensitive to bending stresses both in the plane transverse to the direction of displacement of the vehicle and parallel to this direction, sustains flexure-type oscillations of the system and generally limits the handling characteristics of the vehicle.

OBJECTS OF THE INVENTION

It is the principal object of the present invention, therefore, to provide a lifting mechanism for a lift vehicle or the like in which the aforedescribed disadvantages are avoided and, especially, a satisfactory field of view can be provided for the vehicle operator, the mechanism or device has low-manufacturing cost, and the device has an optimum stiffness.

it is another object of the invention to provide a lifting device for a fork-lift or similar industrial vehicle which is less sensitive to vibration or operational instability than prior mechanisms and which, for low cost and with little weight, can be used to manipulate relatively large loads.

SUMMARY OF THE INVENTION

These objects and others which will become apparent hereinafter are attained, in accordance with the present invention, in a lifting rack or structure which comprises two laterally offset coplanar uprights each of which is provided with a movable mast member peripherally enclosing or surrounding the stationary uprights over a major portion of the periphery thereof.

The term "lift rack" is used herein to define a frame or like structure, generally composed of steel, which comprises a support member to which the so-called "stationary" uprights are affixed and by means of which the rack is mounted upon the vhicle, a pair of movable uprights which are telescopically interfitted with the stationary or lower uprights and which are joined together at the upper ends of the movable uprights, and a lift member mounted upon these movable uprights for engagement with a load.

This assembly, whether provided upon a vehicle of the self-propelled type or upon a carriage which must be moved by manpower is the "rack" of the present invention. Preferably, the elevatable or movable uprights, hereinafter also identified as mast members, receive the stationary or lower uprights or mast members and extend all around the latter. Advantageously, the vertically displaceable uprights are tubular and completely surround the lower uprights when the movable uprights are lowered thereover. The telescopically intefitted uprights on each side of the rack thus define a vertically elongatable column which supports the load-engaging means, preferably a lifting fork.

Advantageously, each of the upper column members, which are elevatable as stated earlier, is of unitary construction, i.e. is undivided and unslit so that they are continuous tubular structures simply slipped over the lower column members. In the lowermost position of the movable column portions, they may completely enclose the inner column members.

Suprisingly, this structure provides advantages not obtainable with either of the previously described mast systems. Firstly, by comparison with complex profile uprights, the columns of the present system have increased strength and reduced weight and also can be made with great precision, more inexpensively than open profiles of the same stiffness and precision. Thus for the same cost, play can be materially reduced or for given manufacturing tolerances, the cost of the columns is substantially reduced together with a reduction of the column weight.

Furthermore, because the cross-section of the columns of the present rack can be smaller for the reasons already noted, the columns obstruct to a significantly smaller extent, the field of view of the operator and can increase a load-carrying capacity of the vehicle because of their lightness.

According to the present invention, at least the upper movable member of each column is a tube or pipe of circular cross-section. However, where it is desired to increase the stiffness of the columns against bending stresses by the load in respective vertical planes perpendicular to the common column plane, the tube may have an oval cross-section with the major axis of the oval lying at right angles to the common column plane and the broad sides of the columns confronting one another. This arrangement is particularly desirable because of the increased field of view provided thereby, A figure-eight profile, wherein the center of the oval is pinched inwardly, is also advantageous for this reason.

According to another feature of the invention, the load-engaging device comprises a carriage which is vertically shiftable on the tubular movable column members and preferably has a pair of sleeves which surround the movable column members and are axially shiftable therealong. The tubular column members may be secured together by a plate bridging their ends above the last-mentioned sleeves. The sleeves preferably completely surround the peripheries of the movable column members upon which they are axially shiftable.

According to still another feature of the invention, the lifting mechanism comprises piston-and-cylinder means in (or constituted by) the two columns for hydraulic pressurization to raise the upper column members. Most advantageously, the stationary or lower column members of each column is constituted as an upwardly open cylinder into which reaches a plunger-type piston depending from the movable assembly and coaxially received in each of the upper column members. This system has been found to be particularly desirable since the fluid under pressure in the interior of the lower column members increases the stiffness of the entire rack.

According to another feature of the invention, the cylinders or lower column members are formed at their upper ends with seals which peripherally engage the plunger-type pistons and are readily accessible (e.g. for replacement) when the movable structure is removed.

In addition, I prefer to provide between the outer surface of the inner or stationary column member and the inner surface of the outer column member a guiding system (linear slide bearing) which coacts with the aforementioned seal so that the seal and the guide bearing bridge narrow spaces between the plunger-piston and the cylinder and between the cylinder and the outer tubular column member. The seal and guide ring are thus not exposed to substantial transverse forces.

At the lower end of the plunger-piston, moreover, I provide a guide member in sliding engagement with the walls of the cylinder to further stabilize the system and prevent canting of the upper column member relative to the lower column member when the columns are fully extended or in any other relative position of the two column members. The formation at the lower end of the plunger-piston can, of course, also act as a holder engageable with the inner seal of the cylinder to act as a stop preventing excursion of the piston out of the cylinder and undesired release of the upper movable member. Of course, a stop formation of this type can also be provided independently of a guide structure and vice versa.

Alternatively, the upper column member of each column may be constituted as a cylinder, whereupon the lower column member may be formed as a plunger piston. In this case, a duct in the stationary column member may communicate hydraulic fluid under pressure to the cylinder formed by the upper column member above the seal of the latter hugging the lower column member.

According to another feature of the invention, the load-bearing carriage is actuatable independently of the vertically displaceable column members upon which it is slidably mounted or is displaceable thereon with a free stroke prior to movement of the upper column members.

A chain (elongated flexible element) is, according to this aspect of the invention, anchored at one end to the carriage and is passed over at least one idler roll or sprocket wheel prior to being anchored to another location to the rack structure. Where only relative displacement of the carriage and the upper column members is desired, the other end may be anchored to the upper column member or to a hydraulic cylinder arrangement for displacing the chain and the carriage to which it is affixed. Alternatively, a fixed anchorage may be provided for this other end of the chain on the vertically displaceable column members while the roll or sprocket may be formed with a hydraulic cylinder arrangement for displacing the chain and the carriage to which it is affixed relative to the movable column members. Furthermore, where an automatic elevation of the carriage relative to the upper column members is desired at the latter are extended, the other end of the chain may be anchored to the support upon which the stationary or lower column members are affixed.

In all cases, it is desirable to provide the chain arrangement so that the load-carrying member has its fork lying upon the ground prior to elevation and can be elevated independently of or relative to the upper column members before the latter are displaced.

More specifically, the load-bearing carriage is connected to one end of the chain whose outer end is affixed to one of the mast sections (i.e. the movable or stationary mast sections) and is engaged or deflected around a wheel whose axis is vertically displaceable by a piston-and-cylinder arrangement. Where free displacement of the carriage is desired prior to displacement of the movable mast section, the latter cylinder arrangement is disposed between the chain-deflecting wheel and the movable mast section.

It has been found to be advantageous in some cases to connect the hydraulic cylinders of the movable mast section and the chain-displacing cylinder hydraulically in parallel. In this construction, the hydraulic cylinder for the chain-deflecting wheel is formed with a larger effective piston surface area than the total piston surface area for the mast-lifting cylinders and is preferably more than twice this total area. Consequently, the force applied to the chain-deflecting roll will be greater and will increase at a more rapid rate than the total lifting force upon the movable mast section even though all of the cylinder are charged with fluid simultaneously.

Where the cylinder arrangement for the independent displacement of the load-supporting carriage or slide is connected to the movable mast section, the carriage and slide can only be displaced relative to the movable mast section until the connecting element comes to rest upon this cylinder or, where the connecting element is provided with cutouts (e.g. where the sleeves are slit at corresponding locations), to a distance beyond that to which the stroke of the slide would otherwise be limited.

The hydraulic medium is supplied to the chain-wheel cylinder by a duct connected at one end to the cylinder and at the other end to the rack or frame, the duct being coiled helically around the cylinder so that it can be drawn off axially as the upper mast section elevates without significantly obstructing the opeartor's field of view.

Preferably, the sleeves of the slide or carriage are provided with roller which engage the movable mast section with low friction. Where the upper column members are cylindrical, as described above, it suffices that each column member can be engaged by a lower forward roller and an upper rearward roller, the rollers having a profile complementary to that of the upper column member engaged thereby to resist lateral forces. Alternatively, the relatively slidable parts of the guide sleeves and the upper column members can be provided of a self-lubricating material (e.g. steel impregnated with or containing molybdenum sulfide or polytetrafluoroethylene sleeves) so that long-term lubrication, without deposition of a contaminant-retaining film is ensured.

According to another feature of the invention, the lower column members or stationary column members are mounted upon a common transverse support and the latter forms a frame receiving the upper column member between itself and the lower column member, thereby imparting greater stability to the mast.

The support is provided with means for pivotally mounting the frame and the mast of which it forms part upon a portion of the vehicle chassis, hydraulic means being provided to tilt the mast about the pivot defined between the support and the chassis. A single tilting cylinder may be used for this purpose and, where provided, is disposed centrally between the two columns. Where space is not available for the tilting cylinder location, two such cylinders may be provided symmetrically (with respect to a medium plane through the frame parallel to the direction of displacement of the vehicle) to either side. The frame may be received within and project beyond the chassis.

The spacing between the frame members and the stationary column members can be designed to be only slightly greater than the sum of the wall thicknesses of the movable column members and the sleeves for the load-carrying carriage whereby the sleeves and the upper column member are received between the frame and the lower column member with a minimum of play.

While the pivots for the support can be located in a plane in which the upper and lower column members lie, it is also contemplated, where necessary, to offset the columns with respect to the pivot or to have the columns provided with a set-back within which the pivot is located. In this way, the center of gravity of the mast can be disposed at any desired location with respect to the pivot so that, for example, the center of gravity of the mast may be located on one side of the pivot while the load center of gravity is located on the other.

Outriggers can be provided parallel to the vehicle path so that the tilting cylinders may be approximately vertical and can engage the frame.

According to another feature of the invention, the frame members at the base of the mast are provided with stiffening portions which bridge the two frame members straddling the lower column members and which themselves may be traverses or the like. In addition, stiffening members in the form of webs may be provided between a base plate and vertical members of the frame assembly. Such stiffening members are designed to provide an increased steel cross-section in the regions of the largest bending moment.

To minimize interference with the field of view of the vehicle operator, especially when displacement of the carriage via a chain and displacement of the chain by a hydraulic cylinder arrangement supplied with fluid through a duct is contemplated, I dispose the chain and the fluid-supply duct in a common vertical plane along the longitudinal axis of the vehicle, the deflection wheel for the chain being likewise included in this plane and being disposed at an upper portion of the mast.

For guiding the movable mast members, I provide at the upper end of each stationary post or column and at the lower end of each movable post or column a slide surface or member, preferably of a self-lubricating or low-friction material, e.g. polytetrafluoroethylene or polyethylene impregnated with molybdenum sulfide, for long-term lubrication and freedom from contamination.

In addition, it should be noted that the movable mast section may comprise a plurality of upper column members which telescopically interfit in one another so that the total height to which the load may be elevated may be twice or three times or more greater than the height of the stationary column members. In this case, the construction is facilitated by making the hydraulic cylinder for the extension of the assembly in the upper column member and providing the lower column member as a plunger-piston. The upper column member can comprise two or more telescopingly interfitted tubes, the innermost of which hugs the plunger-piston formed by the lower mast member. Since the cross-section of the outer tube of the upper column member is larger, the introduction of hydraulic fluid under pressure will initially cause the outer tubes (with all of the inner tubes nested therein) to rise along the stationary column members and, when the outer tube reaches its maximum height as defined by engagement of the innermost movable tube with the abutment on the plunger-piston of the inner column member, the mast will continue to rise with the inner tube held stationary as each tube progressively reaches its maximum extension, whereupon the vertical displacement of the carriage on the outer tubes is permitted.

The chain for the carriage may thus have an S-configuration, passing over two or more deflecting rolls as described in French Pat. No. 1,096,296. The telescoping upper section arrangement, when combined with the use of an S-configuration chain as set forth above, has been found to give rise to a particularly good field of view for the vehicle operator because the carriage lies below his line of sight.

A particularly advantageous construction of the lifting assembly according to the present invention provides a vertically shiftable upper mast section which consists, in turn, of two or more mutually telescoping portions and, in turn, telescopingly receiving the lower mast section, a fork carriage being vertically displaceable on the outermost column member of telescopingly interconnected column members.

According to the principles of this invention, the inner or lower column member of the two telescopingly interfitted column members at each side of the mast and forming the vertically displaceable member, has a piston which, in turn, forms a cylinder for another piston axially shiftable therein and anchored to the outer member of the telescopingly connected pair. Consequently, when fluid is fed under pressure to the stationary column member at the bottom thereof, axial force is applied to the plunger-piston attached to the outermost column member to lift the latter and to the tubular plunger-piston attached to the intermediate member to effect extension of the telescoping mast.

The piston surface of the piston associated with the inner vertically displaceable column members is at least twice as great, preferably more than twice as great, as the effective piston area of the piston associated with the outermost and uppermost vertically shiftable column member. This ensures that, without relative displacement, the two telescoped column members will rise together when hydraulic fluid is fed into the system and only when the column member has reached its uppermost axial position will the outer column member begin its upward movement.

It has been found advantageous to provide the carriage with means for elevating it during the common upward movement of the telescoped movable column members and to retain the carriage in its upper position during vertical displacement of the upper outer column member with the carriage. To this end, a chain has one extremity anchored to the carriage while the other is passed over a wheel journaled on the outer common members, preferably upon a cross-beam connecting same. The other end is divided with a releasable coupling for selectively anchoring the same to the stationary part of the mast or to a vertically movable part thereof so that, in the first position, vertical movement of the wheel raises the carriage and in the second position, the end of the chain shifts with the wheel so that the carriage is retained in its upper position. Preferably, a self-locking arrangement is provided for this purpose although frictional engagement or the like may also be used.

BRIEF DESCRIPTION OF THE DRAWING

In the Drawing:

FIG. 10 is a vertical section through another mast in its lower position;

FIG. 16 is a side-elevational view of a fork lift truck embodying the invention.

SPECIFIC DESCRIPTION

Figure 1:
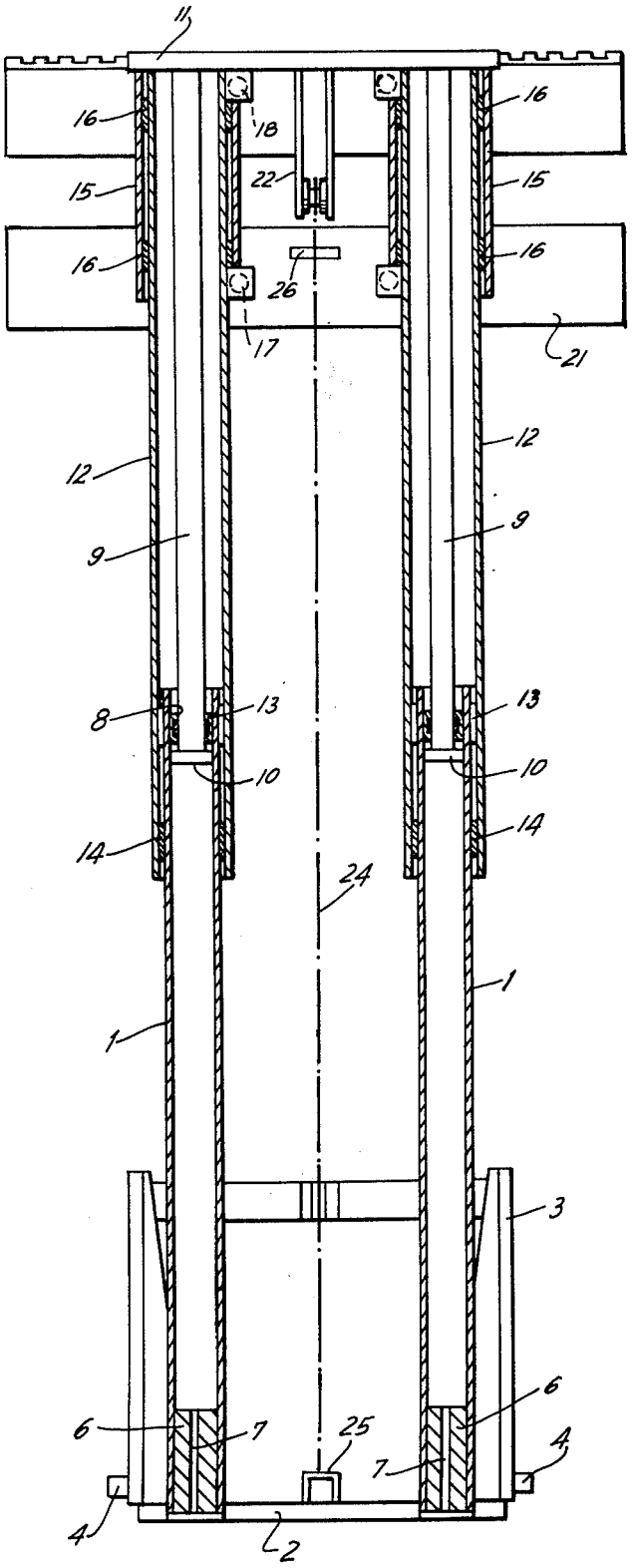
FIG. 1 is a cross-sectional view through the columns of both mast sections, as seen from the rear, of a lift according to the present invention, the bottom portion being seen in part from the front.

Referring first to FIG. 16, it will be apparent that a fork lift truck according to the invention may comprise a vehicle body 100 having wheels 101 and a chassis 102. The mast assembly 103, as shown in detail in FIGS. 1 through 15, comprises a lower frame portion 104 pivoted at 105 to the chassis and swingable about the pivot 105 by a hydraulic cylinder arrangement 106 (tilting cylinder). A fork is mounted on a carriage 108 slidable upon the upper mast section 109, here shown to be telescoped over the columns of the lower mast section. As described in connection with FIGS. 1 through 9, means is provided (as controlled by a lever 110) for raising the fork and its carriage 108 shown at upper mast section 109 and for lifting this section relative to the tiltable frame on support 104.

Figure 2:
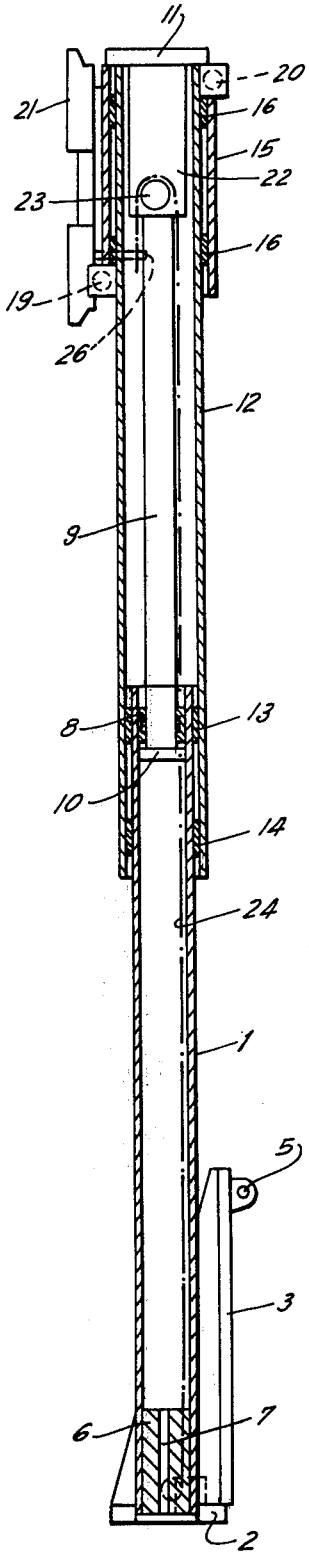
FIG. 2 is a cross-sectional view through one of the columns of FIG. 1 as seen in a view rotated through 90° about the axis of this column.
Figure 3:
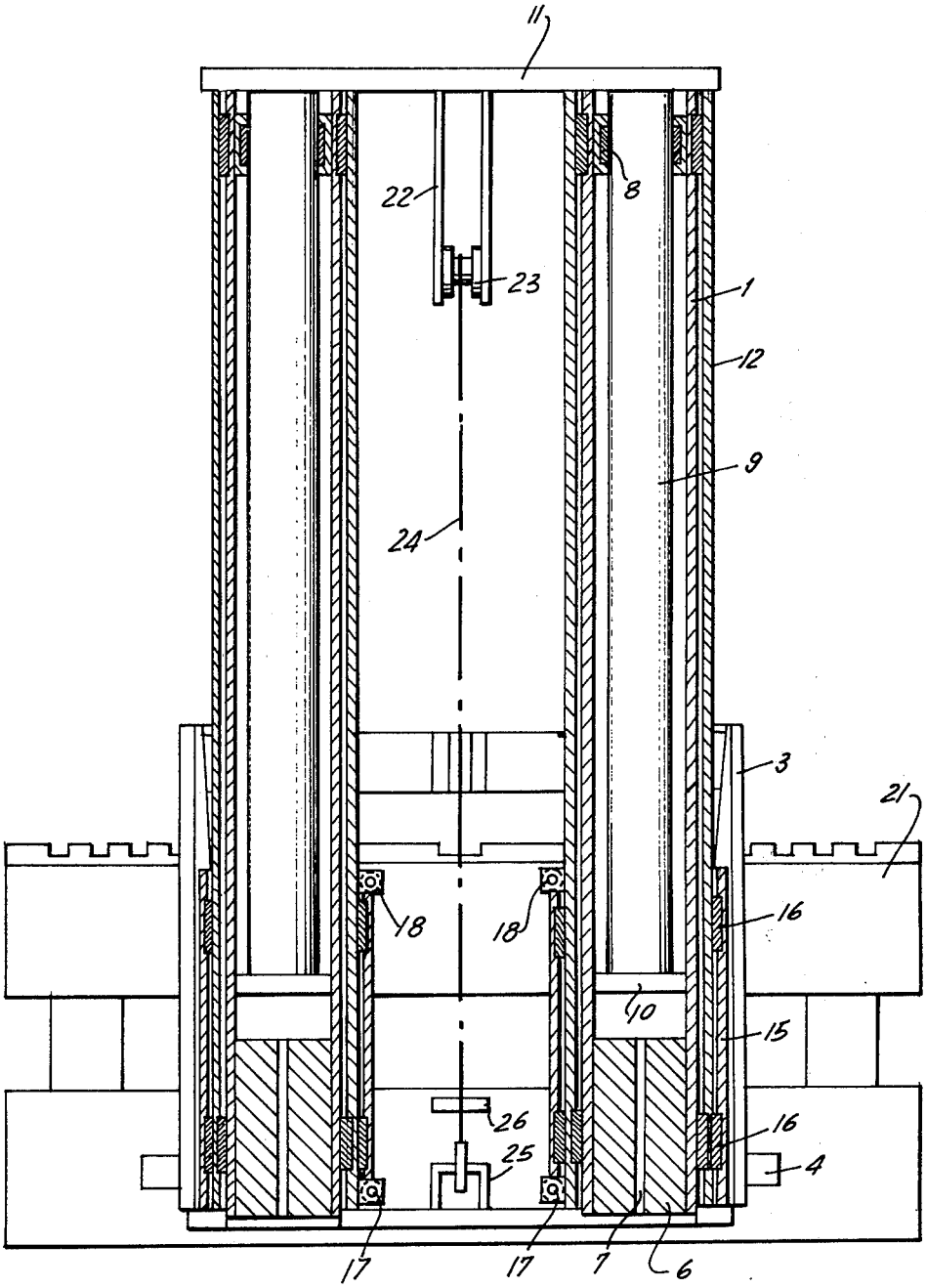
FIG. 3 is a section similar to FIG. 1 in which the upper half section has been lowered to fully receive the column members of the lower mast section.

As can be seen from FIGS. 1 through 3, each of the cylindrical tubular lower column members 1 of the lower mast section is mounted upon a transverse base plate 2 so that the two lower or stationary column members are held together by this plate 2 which , in turn, forms a limb of a frame 3 having an upper cross-bar and a pair of lateral uprights reinforced by triangular webs as shown in FIG. 2. The uprights of the frame 3 are spaced from the outer walls of the lower column members 1 by a distance sufficient to allow the upper column members and the carriage slide, described in greater detail below, to be received between the frame uprights and the lower column members 1.

The frame 3 is provided with a connecting eye or lug 5 to which the tilting hydraulic cylinder arrangement is pivotally connected when the frame 3 and the assembly carried thereby is pivotally mounted upon the chassis via the laterally projecting horizontal stub shafts 4. The mast may be mounted at the front end of a vehicle as described in connection with FIG. 16.

The lower portion of each of the stationary column members 1 is reinforced by a stationary plug 6 which augments the bending stiffness of the lower column members and serves to feed hydraulic fluid to the interior of the lower column members 1 which constitute cylinders for raising and lowering the upper mast section. To this end, each stiffening plug 6 is provided with an axial bore 7, the bores 7 being connected in parallel to a valve operated by the control member 110 and communicating with a pump for generating a hydraulic pressure.

At the upper end of the stiffener column member 1 there is provided a seal 8 in which a plunger piston 9 is axially guided, the plunger piston 9 having at its lower end a guiding shoulder 10 which slides along the inner wall of the lower column member 1 but is provided with passages so that hydraulic fluid can pass this shoulder.

At their upper ends, the plunger pistons 9 are connected to a horizontal beam 11 to which, in addition, the vertically displaceable upper column members 12 are affixed. The upper column members 12 are telescoped over the lower column members 1 as a comparison of FIGS. 1 and 3 will show.

At the upper end 9 of the lower column members 1, there is provided an external slide bearing and guide ring 13 upon which the inner wall of the associated upper column member 12 is slidable. At the lower end of each upper member 12 a similar guide ring and slide bearing 14 is formed for slidable engagement with the outer surface of the lower column member 1. This double guide and slide bearing arrangement ensures that the two upper column members are slidably guided on the two lower column members in two vertically spaced horizontal planes for maximum stability. Since the seal 8 lies in the same plane as the guide ring 13, it remains free for transverse and bending stresses regardless of the degree of excursion of the upper mast section.

Each vertically displaceable mast section is provided with a guide portion 15 in the form of a sleeve with two slides 16 and lateral rollers 17, 18, lower rollers 19 and upper rollers 20. The sleeve 15 formed together with the fork carrier 21 is the load-engaging carriage of the assembly.

The upper cross-beam 11 is provided with a pedestal 22 in which a wheel 23 is journaled in a vertical plane through the longitudinal axis of the vehicle so that the axis of this wheel lies perpendicular to this vertical median plane. The wheel 23 may be provided with teeth or seats in the manner of a sprocket wheel and serves to deflect a chain 24. The chain has its lower end affixed at 25 to the lower traverse of beam 2 and its upper end tied at 26 to the fork carriage 21.

If a hydraulic cylinder arrangement is provided upon the carriage to displace the latter relative to the chain or upon a movable member of the system, or at an upper location, the pedestal 22 is formed with support rollers 27 (see FIG. 4) over which the hydraulic duct or conduit 28 is guided. The duct thus lies in the vertical median plane through the vehicle parallel to its direction of displacement and has a minimal effect upon the field of view of the vehicle operator.

The operation of the device is best seen from FIGS. 1 and 3, the latter representing the mast in its lower position. In this embodiment as well, the fork carriage is not capable of executing free vertical displacement, i.e. vertical displacement independently of the upper mast section.

With the upper mast section in its lower position and the carriage lowered fully (FIG. 3) the vehicle (FIG. 16) can be advanced to insert the tines of the fork into the slots of a pallet. The cylinder (106 in FIG. 16) can be operated to tilt the assembly and allow transport of the load or its pallet. Since the sleeves 15 of the carriage and the outer column members 12 are disposed, in the lower position (FIG. 3), between the stiffening plug 6, the wall of lower column member 1 and the outer members of frame 3 with a minimum of play, lateral forces are transmitted directly to the support 3 and thus to the vehicle itself without conversion into bending stresses.

Hydraulic fluid under pressure is admitted via bores 7 to the interior of the lower column members 1 and flows past the shoulders 10. Since a seal is provided at 8, a force equal to the product of the hydraulic pressure and the cross-sectional area of the plunger piston 9 behind the shoulder 10 will be exerted in the upward direction to elevate the column members 12.

The carriage 21, of course, is drawn upwardly at twice the speed of the column 12 because of an upward entrainment of the pedestal 22 and the wheel 23 with the carriage 21.

Figure 7:
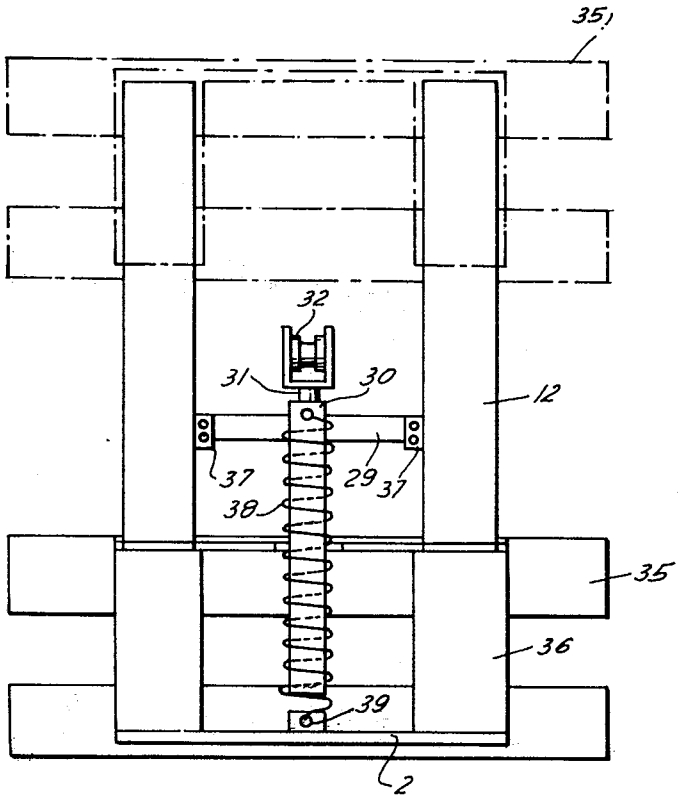
FIG. 7 is a view similar to the view of FIG. 5 but showing the assembly in its lowered position.
Figure 4:
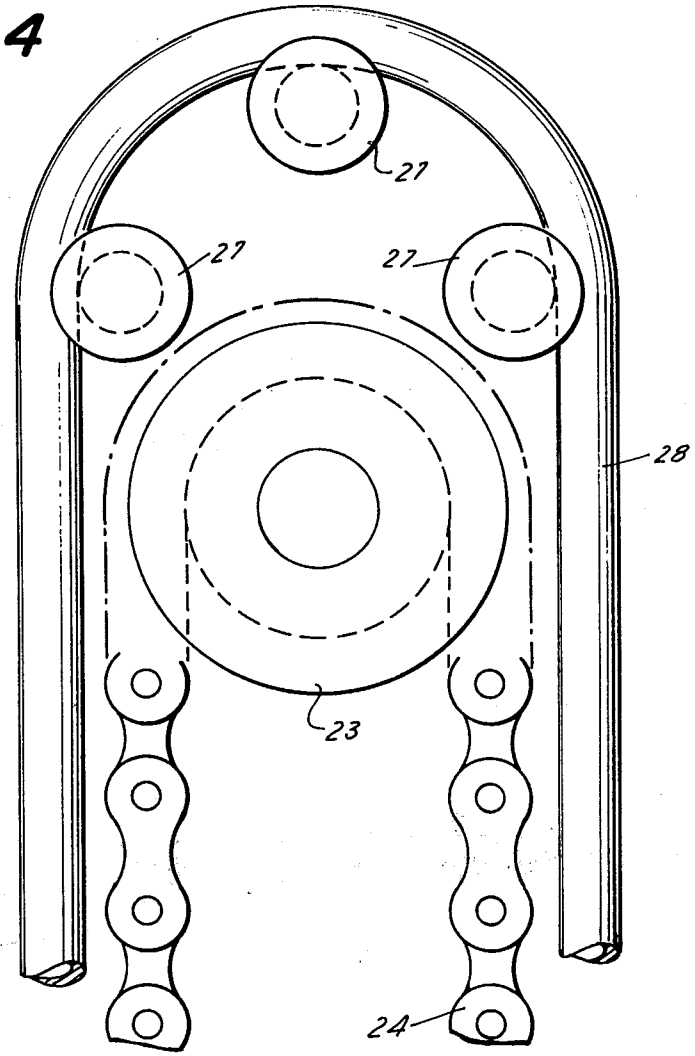
FIG. 4 is a detail of the hydraulic-fluid conduit arrangement for a lifting device of this type.
Figure 5:
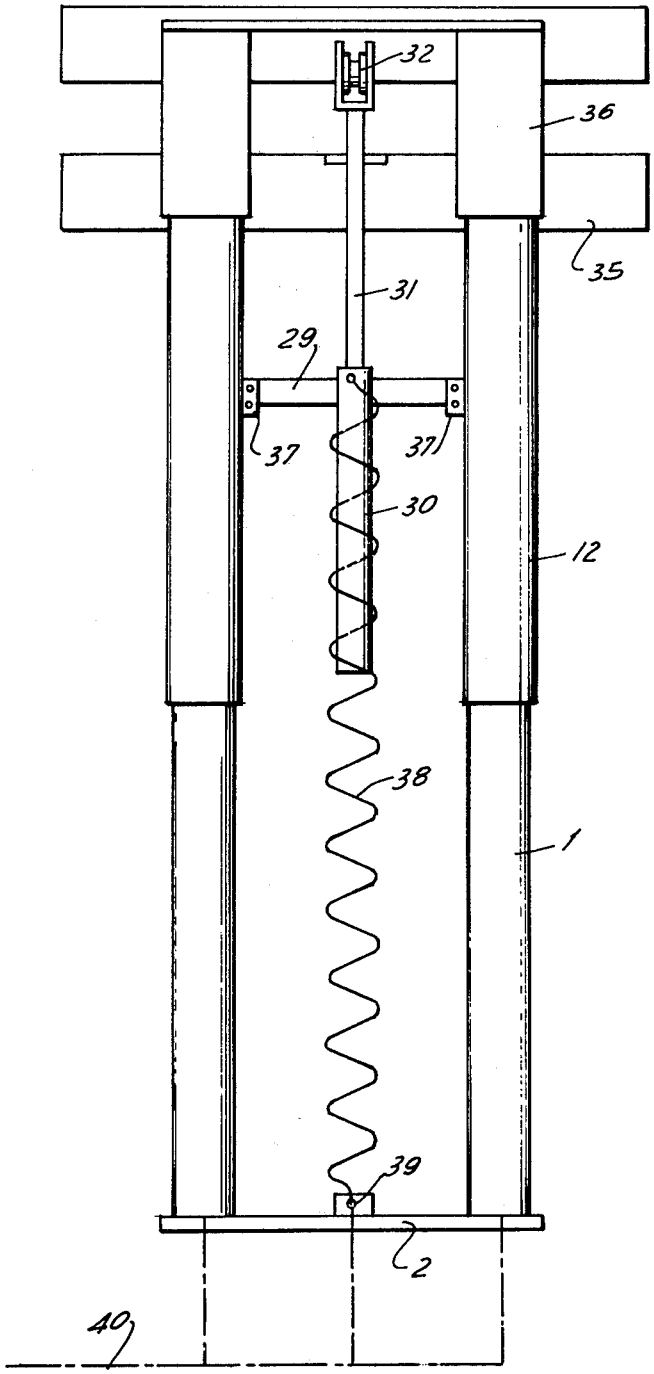
FIG. 5 is a rear elevational view of a lift provided with a free stroke (independent of elevation of the upper mast section) for the load-carrying fork.
Figure 6:
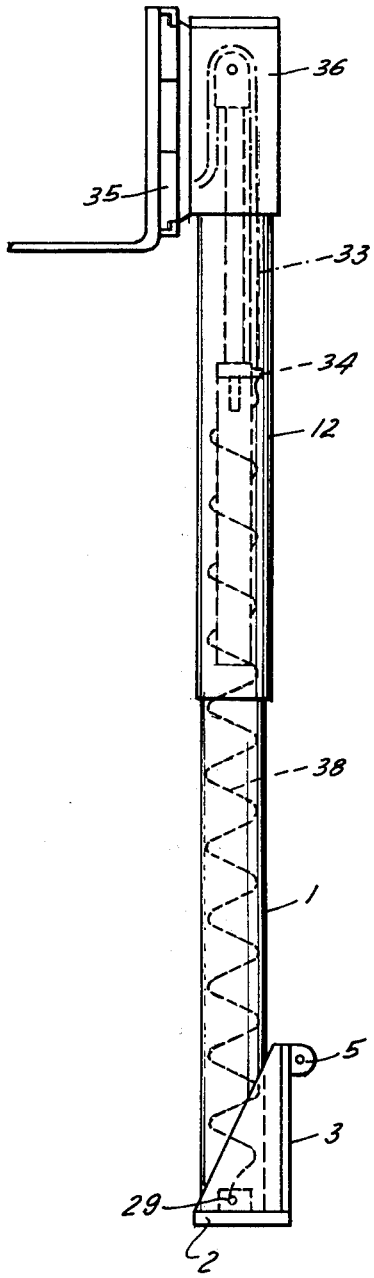
FIG. 6 is a side elevational view partly in diagrammatic form taken at right angles to the view of FIG. 5 showing the vertically extended lifting device.

In FIGS. 5 through 7, the lifting apparatus has elements 1 through 5 in common with the similarly numbered elements of FIGS. 1 through 3 and the vertically shiftable column members 12 are the same although between the two upper column members 12 a traverse 29 is provided. The traverse 29 carries a hydraulic cylinder 30 whose piston rod 31 is provided at its upper end with a wheel 32 engaging a chain 33. One end of this chain is fixed at 34 to the cylinder 30 while the other end is anchored to the carriage 35. The guide sleeve 5/36 of the latter are slit to permit passage of fastening members 37 whereby the traverse 29 is anchored to the vertically displaceable column members 12.

The cylinder 30 is supplied with hydraulic fluid via a duct 38 which is helically coiled around the seal and communicates at 39 with a hydraulic line connected in parallel to the hydraulic cylinder formed by the lower column member 1.

Figure 8:
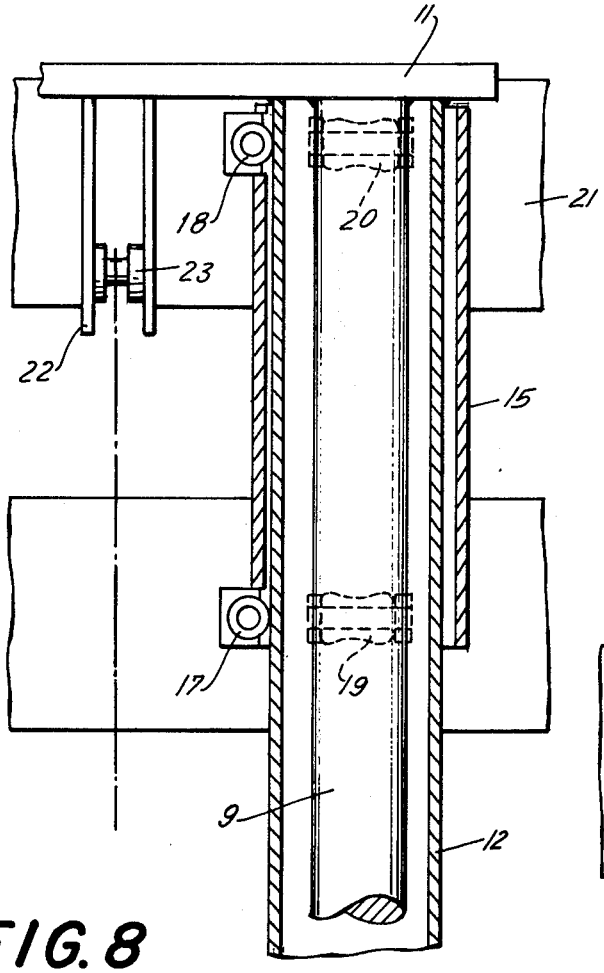
FIG. 8 is a detail of a fork carriage according to the invention, with parts proken away and parts in section.

FIG. 8 shows the arrangement of sleeve 15 and the various guide and support rolls in greater detail.

In the system of FIGS. 5 through 7, the upper mast section is elevated in the manner previously described except that the hydraulic fluid supply to the cylinder 30 preferably causes vertical displacement of the carriage 35 ahead of the displacement of the upper column members 12 or concurrently therewith along the lines stated earlier. The coiled arrangement of the duct prevents excessive obstruction of the field of view of the operator.

Figure 9:
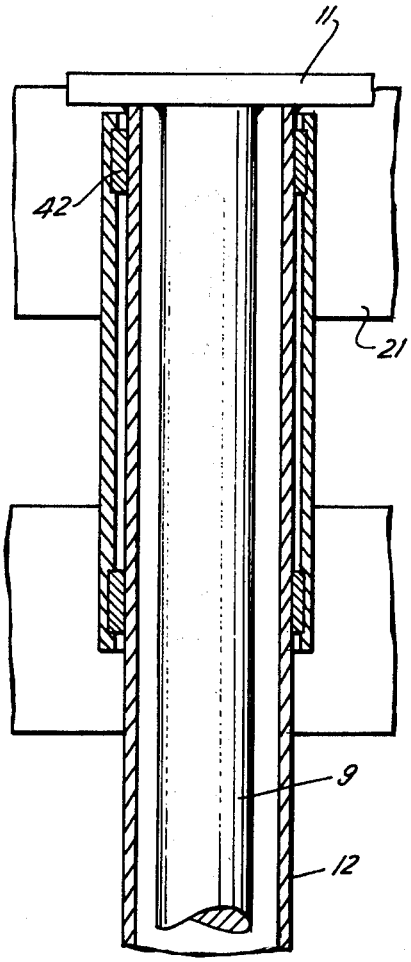
FIG. 9 is a view similar to FIG. 8 of an alternative thereto.

In FIG. 9 I have shown an embodiment of the invention wherein, in place of the rollers 17, 18, 19 and 20 but at the sleeve 15, guided upon the upper column members 12, slide rings 42 of a self-lubricating type are employed.

Figure 11:
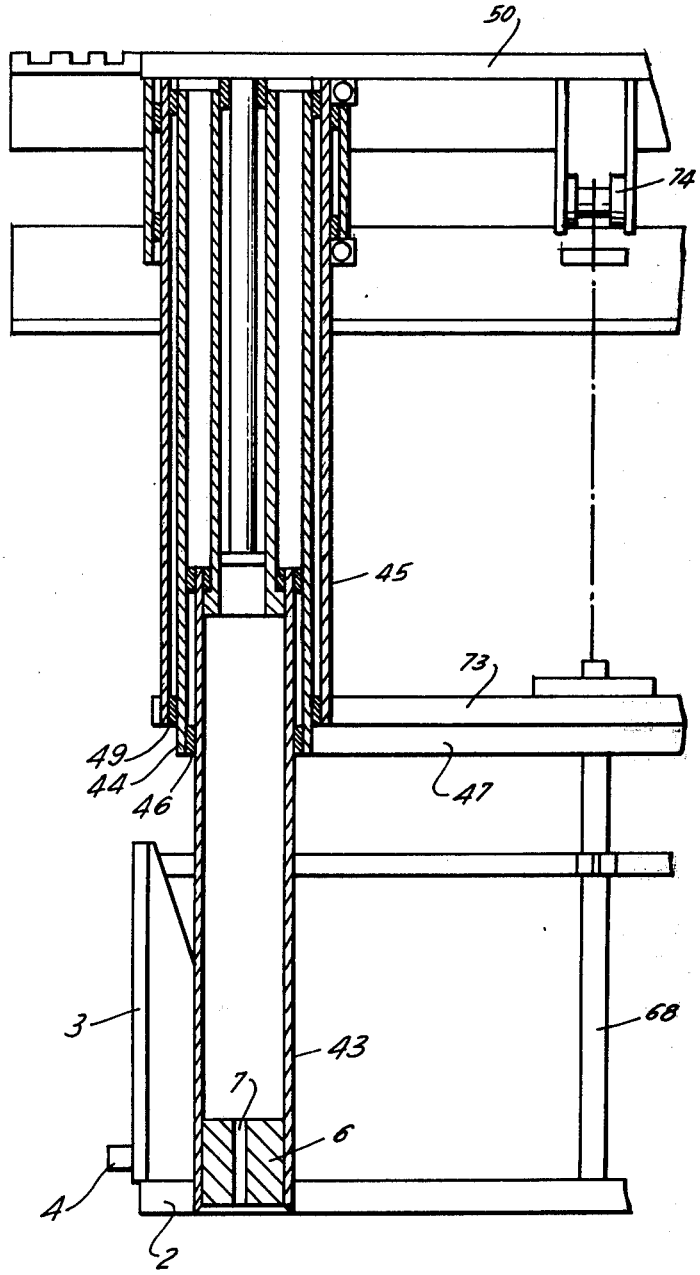
FIG. 11 is a section through a portion thereof in an elevated position.
Figure 12:
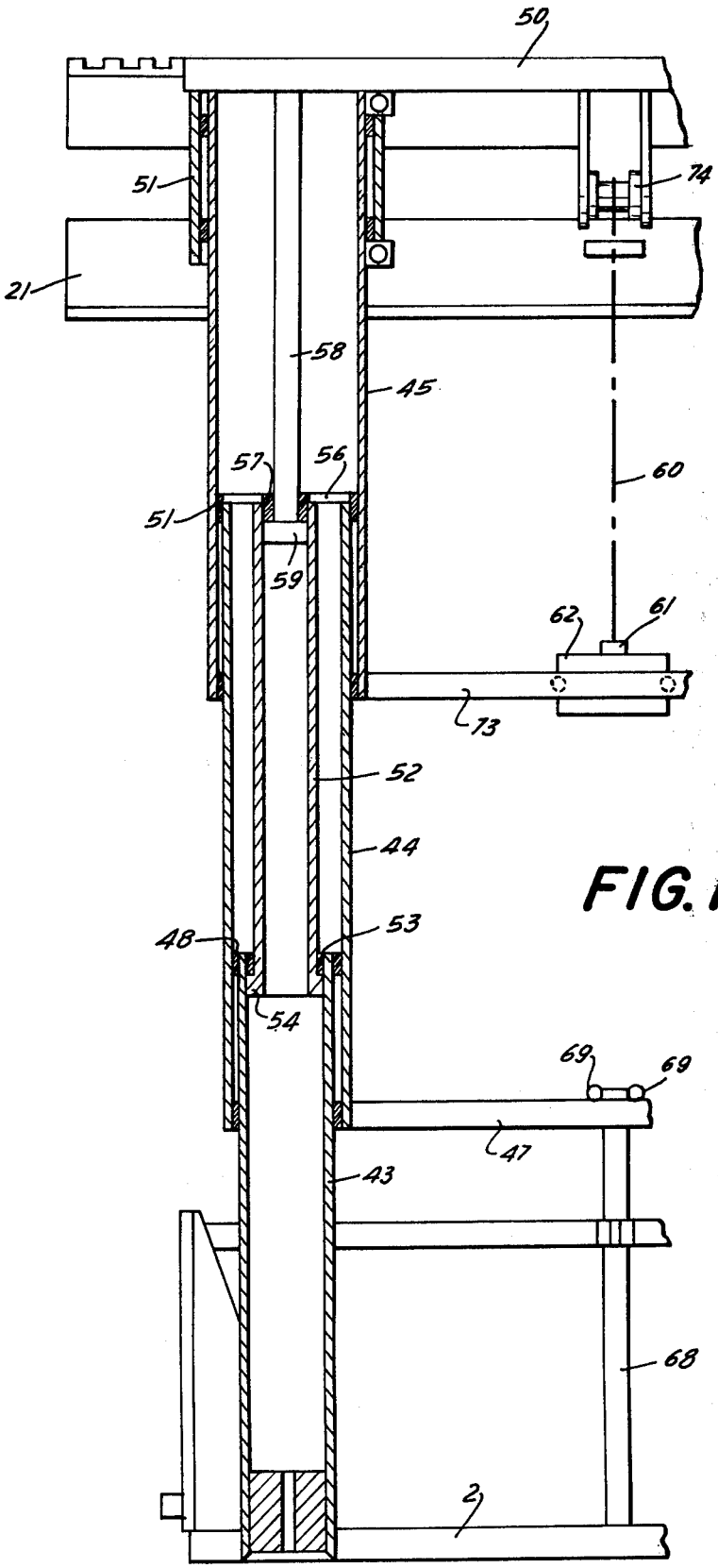
FIG. 12 is a similar view showing the upper mast section still further elevated.

The lifting assembly of FIGS. 10 through 12 comprises a lower support beam 2 forming part of a frame 3 having laterally projecting stub shafts 4 by means of which the assembly can be pivotally mounted on the chassis of a fork-lift truck or like vehicle. In general, these parts are functionally and structurally identical to those described in connection with FIGS. 1 through 9. Similarly, the fork carriage 21 and stiffening plug 6 with its axial bore 7 are the same as the correspondingly numbered elements of FIGS. 1 through 9.

In this embodiment, however, the vertical stationary column members comprise tubes 43 upon which an intermediate tube 44 is slidable, the latter tube forming the inner member of a compound vertically shiftable mast section. The intermediate tube 44 is coaxially telescopingly received in the tube 45 which constitutes the outer member of the upper column portion.

The tubes 44 are provided at their lower ends with slide rings 46 of a self-lubricating synthetic resin (e.g. polytetrafluoroethylene) and are shiftable along the stationary tubes 43 while being connected with a cross-beam 47. At their upper ends, the stationary tubes 43 are provided with low-friction guide rings 48 upon which the inner surface of the corresponding tube 44 slides.

The tubes 45 of the upper mast section are provided at their lower ends with low-friction slide rings 49 which engage the outer peripheries of the corresponding tubes 44 which each, in turn, has at its upper end a low-friction slide ring 51 engaging the inner surface of the outer tube 45. The outer tubes are connected at their upper ends by a cross-beam 50 and at their lower ends by a cross-beam 50 and at their lower ends by a cross-beam 73, the upper beam 59 serving as a support for a chain wheel 74.

The upper ends of tubes 44 of the lower portion of the vertically shiftable mast section are provided with cross-bars 56 upon which the plunger piston 52 is mounted, the latter extending coaxially into the tubes 43 and being formed at their lower ends with guide rings 54. Packings 53 seal the plunger pistons 52 with respect to their tubes 43.

The plunger piston 52, moreover, forms a seal which is sealed at its upper end by a packing 57 (FIG. 12) through which the plunger piston 58 slidably extends at its upper end. The plunger 58 is connected to the cross-beam 50 and at its lower end has a guide ring 59. Thus in this embodiment, three telescoping tubes form an elevatable column which is stabilized by the use of two plunger pistons depending in each of the vertically displaceable tubes and fitting into each other.

A chain 60 is guided over the wheel 74 and is connected at one end with the fork carriage 21. The other end of chain 60 is tied via a connector 61 to a clutch arrangement in a housing 62 to the upper part 63 to which the corrector 61 is anchored.

Figure 13:
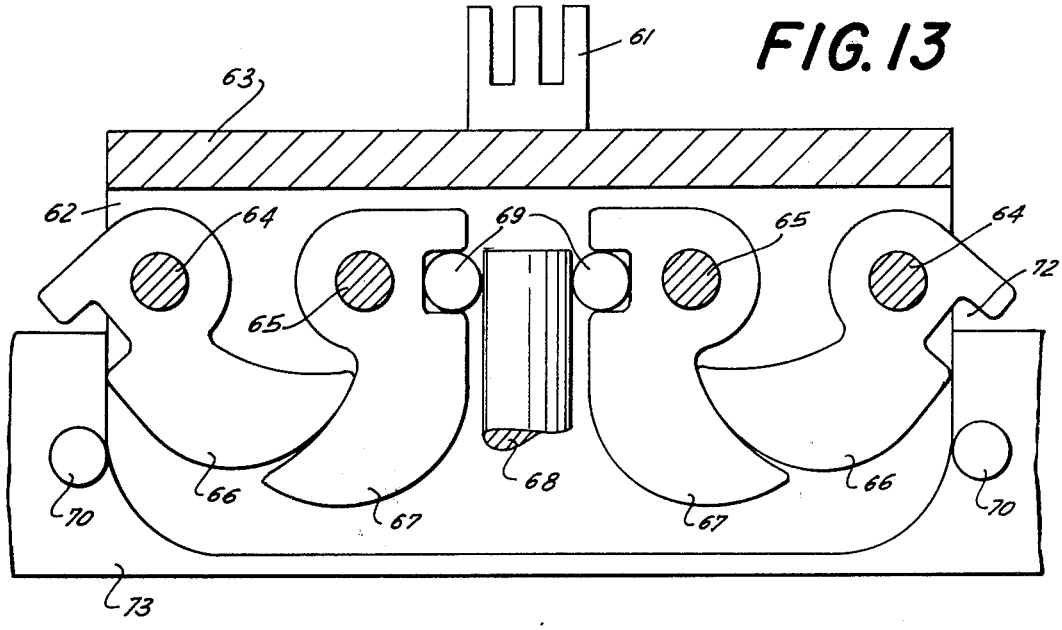
FIGS. 13–15 are views showing a coupling device for the chain in different operating positions.
Figure 14:
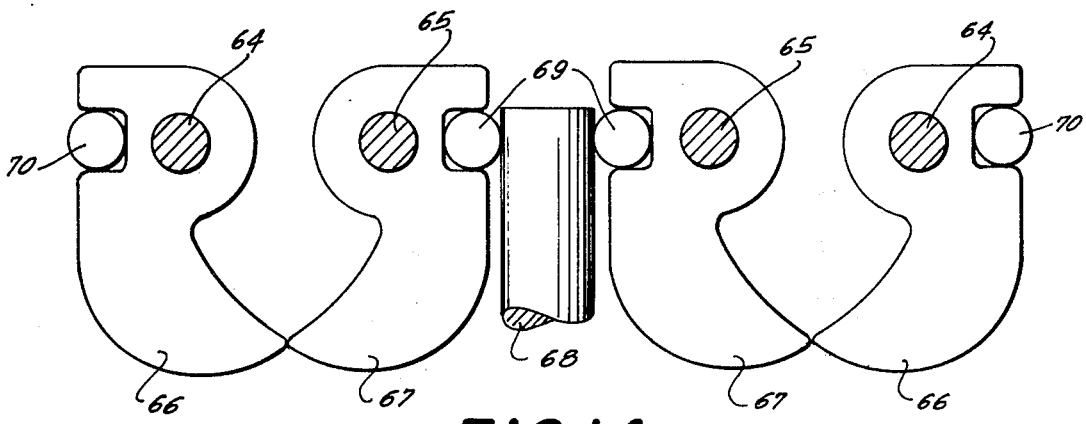
Figure 15:
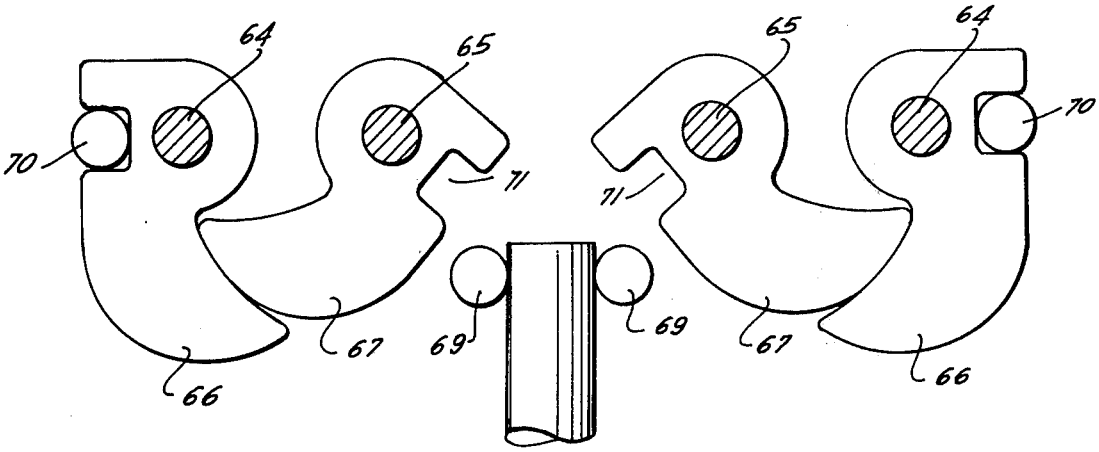

The housing 62 is shown in FIGS. 13-15 is provided with a pair of beams 64 and a pair of pins 65 all extending parallel to one another, and perpendicular to the plane of the column but parallel to the longitudinal median plane through the lift in the direction of vehicle travel. Each of the pins 64 carries a swingable locking member 66 which cooperates with a locking member 67 swingably mounted on the proximal pin 65.

The lower cross-beam 2 is formed with an upstanding shaft 68 at the upper end of which is provided a pair of studs 69 which are engageable in notches 71 of the locking pawl 5/67. Outwardly turned notches 70 of the locking pawls 66 are engageable with respective studs 70 carried by the cross-beam 73.

FIGS. 13 shows the clutch in its position in which the movable mast section collectively has not yet reached its maximum vertical position. In this case, the cross-bar 73 lies below the clutch so that the studs 70 are not yet engaged in the notches 72. However, the studs 69 on the shaft 68 remain engaged with the notches 71 of the locking pawls 67. The pawls 67 cannot be released since they remain blocked by the pawls 66. The chain 60 thus remains rigidly connected to the upper bar 68.

As the two telescoping parts of the upper mast section are forced higher, the lower cross-beams 73 approaches the housing 62 and its studs 70 engage the notches 72 to draw down the lower portion of the locking pawls 66 and release the locking pawls 67. The notches 71 of the locking pawls 67 thereupon swing downwardly (FIG. 15) to release the studs 69 and disengage the clutch 62 from the member 68. The connection between chain 60 and rod 68 is thereupon broken although the clutch housing 62 is now coupled to the cross-bar 73 via the studs 70 and the carriage is retained in its raised position. Of course, the carriage remains raised until, with lowering of the assembly, the clutch housing 72 again engages the upright 68 to release the stud 70 and restore the position shown in FIG. 13.

I claim:

1. A load-lifting assembly for a forklift truck or the like, comprising:

a support;

a pair of transversely spaced upright first column members mounted on said support;

a movable mast section comprising at least one pair of circumferentially closed second column members respectively peripherally surrounding and telescopingly slidable on said first column members and vertically shiftable relatively thereto;

a load-engaging carriage vertically shiftable on said section and displaceable relative to said second column members;

a flexible elongated element connected to said carriage for controlling the displacement thereof; and a hydraulic cylinder arrangement on said section and engageable with said flexible elongated element for displacing said carriage independently of said section, said column members being formed with hydraulic cylinders connected in parallel with said arrangement and chargeable with hydraulic fluid for raising said section, said hydraulic cylinders of said columns having a total surface area effective to lift said section at most equal to the effective surface area of said arrangement serving to lift said carriage.

2. The assembly defined in claim 1 wherein said element passes over a guide wheel and is a chain, said guide wheel being vertically displaceable by said arrangement.

3. The assembly defined in claim 2, further comprising an array of rollers around said wheel and a hydraulic-fluid duct passing over said rollers.

4. The assembly defined in claim 1, further comprising:

a pair of tubular sleeves on said carriage vertically guiding same on second column members, said sleeves being slit parallel to the direction of displacement of said sleeves along said second column members.

5. The assembly defined in claim 4, further comprising roller means between each of said sleeves and said second column members for enabling displacement of said sleeves therealong.

6. The assembly defined in claim 1, further comprising a duct communicating with said hydraulic arrangement for supplying fluid thereto, said duct being coiled around said cylinder.

7. A load-lifting assembly for a forklift truck or the like, comprising:

a support;

a pair of transversely spaced upright first column members mounted on said support;

a movable mast section comprising at least one pair of second column members substantially peripherally surrounding and telescopingly slidable on said first column members and vertically shiftable relatively thereto;

a load-engaging carriage vertically shiftable on said section and displaceable relative to said second column members;

a flexible elongated element connected to said carriage for controlling the displacement thereof; and a hydraulic cylinder arrangement on said section and engageable with said flexible elongated element for displacing said carriage independently of said section, each of said second column members including a pair of telescopingly engaged tubes including an inner tube and an outer tube, the inner tube fitting over the respective first column member and said carriage being formed with sleeves slidably mounted on said outer tubes, each of said inner tubes being formed with a tubular piston axially penetrating into the respective cylinder member upon lowering of said section and each of said outer tubes formed with a further piston axially receivable in the tubular piston of the associated inner tube.

8. The assembly defined in claim 7 wherein the effective surface area of the tubular piston in the upward direction is more than twice as large as the upwardly effective surface area of the piston receivable therein.

9. The assembly defined in claim 7, further comprising a deflecting wheel anchored to said outer tube, said element being a chain passing over said wheel and connected to said carriage at one extremity, said assembly further including coupling means on the other extremity of said chain for selectively connecting same to said support for displacement of said carriage on elevation of said section and to a vertically displaceable portion of said section.

10. A load-lifting assembly for a forklift truck or the like comprising:

a support;

a pair of transversely spaced upright first column members mounted on said support;

a movable mast section comprising at least one pair of second column members telescopingly engaged with said first column members and vertically shiftable relatively thereto;

a load-engaging carriage vertically shiftable on said section and displaceable relatively to said second column members;

a flexible elongated element connected to said carriage for controlling the displacement thereof, said second column members being circumferentially continuous and peripherally surrounding said first column members and being slidably guided thereon, said support being a frame tiltable about a horizontal axis of a vehicle; and a tilting device engageable with said frame at a location spaced from its pivot on said vehicle, said frame comprising a pair of uprights spaced from said first column members by a distance substantially equal to the wall thickness of said carriage and said second column members in lower portions thereof whereby said carriage and said second column members are received between said uprights of said frame and said first column members.

11. A load-lifting assembly for a forklift truck or the like, comprising:

a support;

a pair of transversely spaced upright first column members mounted on said support;

a movable mast section comprising at least one pair of second column members telescopingly engaged with said first column members and vertically shiftable relative thereto;

a load-engaging carriage vertically shiftable on said section and displaceable relatively to said second column members;

a flexible elongated element connected to said carriage for controlling the displacement thereof, said second column members substantially peripherally surrounding said first column members and being slidably guided thereon, one of said pairs of column members being formed directly as first hydraulic cylinders for elevating said section;

a second hydraulic cylinder connected to said element and mounted between said second column members; and means for supplying hydraulic fluid to said cylinders in parallel, said means including a duct coiled around the second hydraulic cylinder and extending to said support.

12. A load-lifting assembly for a forklift truck or the like, comprising:

a support;

a pair of transversely spaced upright first column members mounted on said support;

a movable mast section comprising at least one pair of second column members telescopingly engaged with said first column members and vertically shiftable relatively thereto;

a load-engaging carriage vertically shiftable on said section and displaceable relatively to said second column members;

a flexible elongated element connected to said carriage for controlling the displacement thereof, said second column members each substantially being circumferentially continuous and individually peripherally surrounding said first column members and being slidably guided thereon, said support being a frame tiltable about a horizontal axis of a vehicle; and a tilting device engageable with said frame at a location spaced from its pivot on said vehicle.

* * * * *